US006394596B1

(12) United States Patent
Wotton et al.

(10) Patent No.: US 6,394,596 B1
(45) Date of Patent: May 28, 2002

(54) BELT-TYPE MEDIA SUPPORT FOR A PRINTER

(75) Inventors: Geoff Wotton, Battle Ground; Steve O. Rasmussen; John D. Rhodes, both of Vancouver, all of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/413,078

(22) Filed: Oct. 5, 1999

(51) Int. Cl.[7] ..... B41J 2/01; B65H 29/32; B65H 20/00

(52) U.S. Cl. ..... 347/104; 271/197; 226/172

(58) Field of Search ..... 347/104, 105, 347/106, 115; 271/194, 196, 197; 226/95, 170, 171, 172; 399/384

(56) References Cited

U.S. PATENT DOCUMENTS

| | | | | |
|---|---|---|---|---|
| 3,944,217 A | | 3/1976 | Greene | |
| 4,207,579 A | | 6/1980 | Gamblin et al. | 347/104 |
| 4,737,803 A | | 4/1988 | Fujimura | |
| 4,817,934 A | | 4/1989 | McCormick | |
| 4,878,071 A | | 10/1989 | Bibl | |
| 4,952,950 A | | 8/1990 | Bibl | |
| 5,140,369 A | * | 8/1992 | Haneda et al. | 347/115 |
| 5,287,123 A | | 2/1994 | Medin | |
| 5,296,873 A | | 3/1994 | Russell | |
| 5,371,531 A | | 12/1994 | Rezanka | |
| 5,406,321 A | | 4/1995 | Schwiebert | |
| 5,428,384 A | | 6/1995 | Richtsmeier | |
| 5,446,487 A | | 8/1995 | Russell | |
| 5,467,119 A | | 11/1995 | Richtsmeier | |
| 5,479,199 A | | 12/1995 | Moore | |
| 5,500,667 A | | 3/1996 | Schwiebert | |
| 5,510,822 A | | 4/1996 | Vincent | |
| 5,555,006 A | | 9/1996 | Cleveland | |

(List continued on next page.)

FOREIGN PATENT DOCUMENTS

| | | |
|---|---|---|
| EP | 0693381 | 1/1996 |
| EP | 0705707 | 4/1996 |
| EP | 0773177 | 5/1997 |
| EP | 0875382 | 11/1998 |
| EP | 0917961 | 5/1999 |
| GB | 2238759 | 6/1991 |

OTHER PUBLICATIONS

The Examiner's attention is directed to commonly owned US Patent Applications Nos. 09/163,287; 09/163,275; 09/163,098; and 09/163,274—all filed Sep. 29, 1998.

Hall et al., Inkjet Printer Print Quality Enhancement Techniques, Feb. 1994 Hewlett Packard Journal, pp. 35–40.

European Search Report, Jan. 8, 2001, Application No.: GB0023783.4.

*Primary Examiner*—N. Le
*Assistant Examiner*—K. Feggins

(57) ABSTRACT

A belt-type support for moving print media such as paper through a printer includes a flexible belt that is supported in a manner such that friction is minimized and such that the paper that is supported on the belt is advanced precisely through the print zone of the printer. The support is provided in conjunction with a uniform distribution of vacuum pressure to the paper carried by the belt. In one preferred embodiment, there is provided a rigid, flat platen for supporting a uniformly porous belt. The platen has a number of rollers on its surface to minimize the friction developed between the platen surface and the moving belt. The platen surface also includes ports to provide a uniform distribution of vacuum pressure to the porous belt. In another embodiment, sliders are carried in the support surface of the platen to minimize frictional contact with the moving belt. Another embodiment includes substantially flat platen surface with a low-friction material layer disposed between the belt and platen surface for facilitating movement of the belt over the platen.

13 Claims, 5 Drawing Sheets

U.S. PATENT DOCUMENTS 5,589,866 A 12/1996 Russell
5,633,668 A 5/1997 Schwiebert et al.
5,650,808 A 7/1997 Vincent
5,668,584 A 9/1997 Broder
5,669,032 A 9/1997 Islam
5,717,446 A * 2/1998 Teumer et al. ..... 347/102
5,742,315 A 4/1998 Szlucha
5,754,208 A 5/1998 Szlucha
5,771,054 A 6/1998 Dudek
5,774,155 A 6/1998 Medin
5,809,390 A * 9/1998 Jackson ..... 399/384
5,896,154 A 4/1999 Mitani

* cited by examiner

BELT-TYPE MEDIA SUPPORT FOR A PRINTER

TECHNICAL FIELD

This invention relates to a belt drive system for advancing print media through a printer.

BACKGROUND AND SUMMARY OF THE INVENTION

An ink-jet printer includes at least one print cartridge that contains ink within a reservoir. The reservoir is connected to a print head that is mounted to the body of the cartridge. The print head is controlled for ejecting minute droplets of ink from the print head to a sheet of print medium, such as paper, that is advanced through the printer.

Many ink-jet printers include a carriage for holding the print cartridge. The carriage is scanned across the width of the paper, and the ejection of the droplets onto the paper is controlled to form a swath of an image with each scan. Between carriage scans, the paper is advanced so that the next swath of the image may be printed.

Oftentimes, especially for color images, the carriage is scanned more than once across the same swath. With each such scan, a different combination of colors or droplet patterns may be printed until the complete swath of the image is formed.

In some printers, an array of print heads may be provided to extend across the entire width of the paper that moves through the printer. As is the case with scanning type printers, the relative position of the print heads and paper must be precisely maintained to effect high-resolution, high-quality printing. This precision is especially important in the region known as the "print zone" of the printer, which is the space where the ink travels from the print head to the paper. Changes in the relative position of the print head and paper will cause the expelled ink droplets to land imprecisely on the paper and thus degrade the quality of the printed image.

One method of securing a sheet of paper for movement through a printer is to direct it against an outside surface of a moving carrier such as a hollow cylindrical drum. The curved drum wall has holes through it. The interior of the drum is partially evacuated and the resultant suction is communicated through the holes in the drum to the underside of the paper to thus hold the paper against the drum. The drum is rotated to move the sheet through the print zone to receive the ink. This suction technique for securing the paper to a carrier can be designated generally as "vacuum hold."

Using a drum-type carrier with vacuum hold has at least a couple of disadvantages. For one, relatively stiff paper will resist bending from its normally flat shape to conform to the curved circumference of the drum. Thus, to adequately secure the stiff paper to a drum, the vacuum pressure must be increased, which increases the power required for vacuum hold of stiff paper.

Further, the printer volume required to house a drum can be quite large, especially for printers that are intended to handle large-format print media. It is always desirable to make a printer as compact as possible, without sacrificing performance of the printer.

One way of overcoming the disadvantages associated with drum printers is to employ a perforated belt, one side of which carries the paper. Vacuum pressure is applied to the other side of the belt and thus through the perforations to secure the paper to the belt. The belt, with secured paper, is moved relative to the print head and through the print zone where ink is printed to the paper.

The belt may be configured as an endless loop and secured between a pair of rollers that drive it. The upper surface of the belt between the two rollers can be used for transporting the paper, which can be directed to and removed from the upper surface of the belt in the vicinity of the rollers. Thus, the diameter of the rollers can be minimized so that the belt provides a compact, vacuum-hold-type of print media carrier.

Since a belt-type media carrier is inherently flexible, mechanisms must be employed to ensure that the belt is precisely supported relative to the print head(s). Using a stationary support mechanism for this purpose, however, introduces problems with friction. That is, the belt must be adequately supported by the stationary mechanism in a manner that does not generate significant frictional forces. Too much friction can damage the belt, cause it to slip, or wear.

In addition to addressing these friction problems, a belt-type carrier and associated support mechanism must be constructed so that the vacuum pressure applied through the belt to the paper is evenly distributed. In this regard, the suction or vacuum pressure (here the term "vacuum" is used in the sense of a pressure less than ambient), must be applied in a manner that ensures that the sheet of paper remains in contact with the belt. If, for example, the edges of the sheet lift from the belt as a result of too little vacuum pressure, there is a likelihood that the paper will contact the print head, which is quite undesirable.

If the vacuum pressure level is unevenly distributed, or if the paper is not well supported, the surface of the sheet may become deformed in the places where the relatively high vacuum pressure or inadequate paper support occurs. Such deformations will change the relative position of the paper and print head, and thus lead to the above noted degradation in print quality.

The present invention is generally directed to a belt-type media support for print media that generally overcomes the disadvantages that arise with drum-type carriers and addresses the other problems just discussed. In short, the invention provides a flexible belt that is supported in a manner such that friction is minimized and so that the paper supported on the belt is advanced precisely through the print zone of the printer. A uniform distribution of vacuum pressure is applied to the paper carried by the belt.

One preferred embodiment of the invention features a rigid, flat platen for supporting a substantially porous belt that carries the paper. The platen has a number of rollers mounted to its surface to minimize the friction developed between the platen surface and the moving belt. The platen surface is configured to provide a uniform distribution of vacuum pressure to the porous belt, which pressure is channeled to the paper carried by the belt.

In another embodiment, specially configured sliders are carried on the support surface of the platen. Like the rollers, the sliders reduce the area of contact with the belt to thus reduce friction. Also, the sliders are shaped to limit the amount of area of the belt to which vacuum pressure is applied, thereby to minimize frictional forces while supporting the belt in a position spaced from the platen support surface. The sliders combine with a belt for communicating vacuum pressure from the support surface of the platen through aligned holes in the otherwise non-porous belt. The vacuum pressure is channeled to the paper that is carried on the belt.

In yet another embodiment, the friction between the belt and the substantially flat platen surface is minimized by a coating of low friction material applied to at least the surface of the belt that contacts the platen surface. This platen surface preferably includes protrusions that are mounted to the platen surface and that define the channels for distributing vacuum pressure to the belt.

Other advantages and features of the present invention will become clear upon review of the following portions of this specification and the drawings.

DETAILED DESCRIPTION OF PREFERRED EMBODIMENTS

Figure 1:
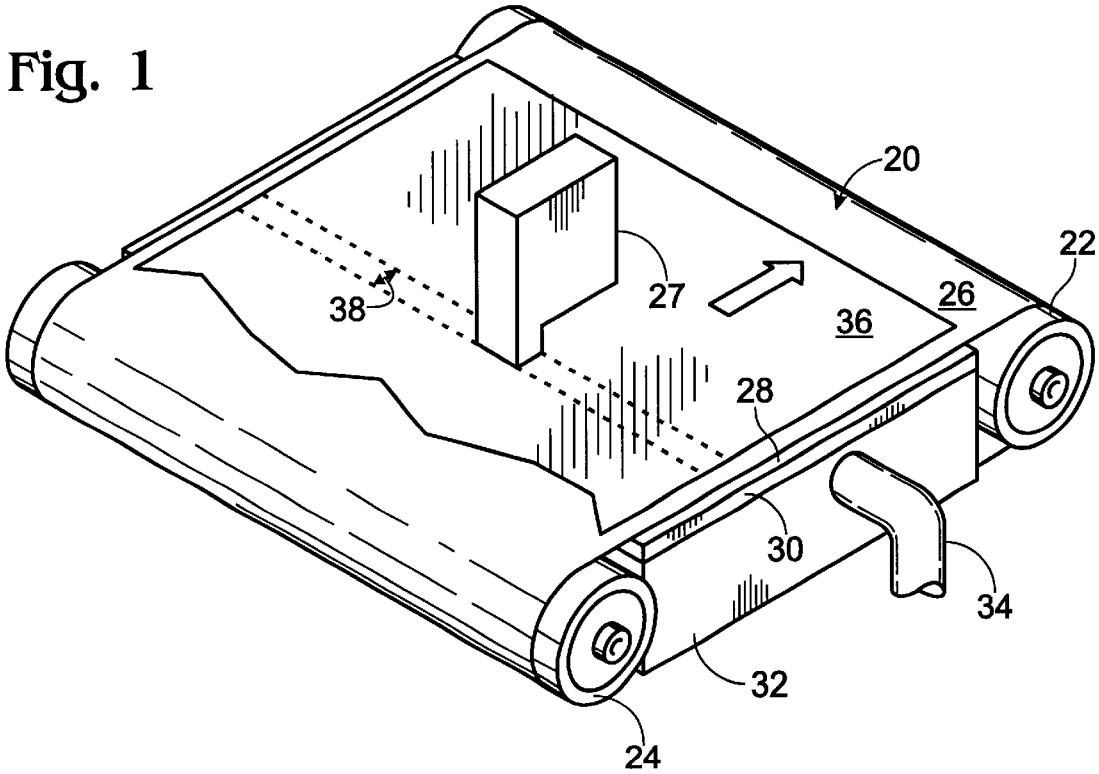
FIG. 1 is a perspective view that illustrates one embodiment of a belt-type support apparatus for print media.

With reference to FIG. 1, the present invention is generally directed to a belt-type support for media that is advanced through a printer. The belt 20 is a generally flexible member that is configured as an endless loop to extend between a fixed drive roller 22 and tension roller 24. The upper surface of the belt 20 is a transport surface 26 that moves over a planar support surface 28 of a platen 30.

The platen 30 forms the top of a vacuum box 32 that fits between the rollers 22, 24 inside the loop of the belt 20. The vacuum box 32 is generally hollow and thus defines a chamber that is partially evacuated via a suitable conduit 34 to a vacuum source (not shown).

Vacuum pressure developed in the box 32 is communicated through ports in the platen 30 to the underside of the belt 20. The pressure is distributed to print media, such as a sheet of paper 36, which is directed onto the belt's transport surface 26 by conventional pick and feed roller mechanisms (not shown).

A conventional ink-jet print cartridge 27 is supported by the printer for reciprocating scanning across the width of the paper 36. The cartridge includes on its underside a print head for expelling droplets of ink to the underlying paper 36. As noted, this printing occurs in the print zone of the printer. The projection of the print zone onto the paper 36 is shown as dashed lines 38 in FIG. 1.

The transport surface 26 and the paper 36 that it carries are precisely supported so that the paper will move through the print zone 38 in a manner such that the neither the belt nor the paper will shift to thus undesirably change the relative position of the paper and the print head. Also, friction is minimized with respect to the moving belt 20 and the stationary platen 30.

Figure 2:
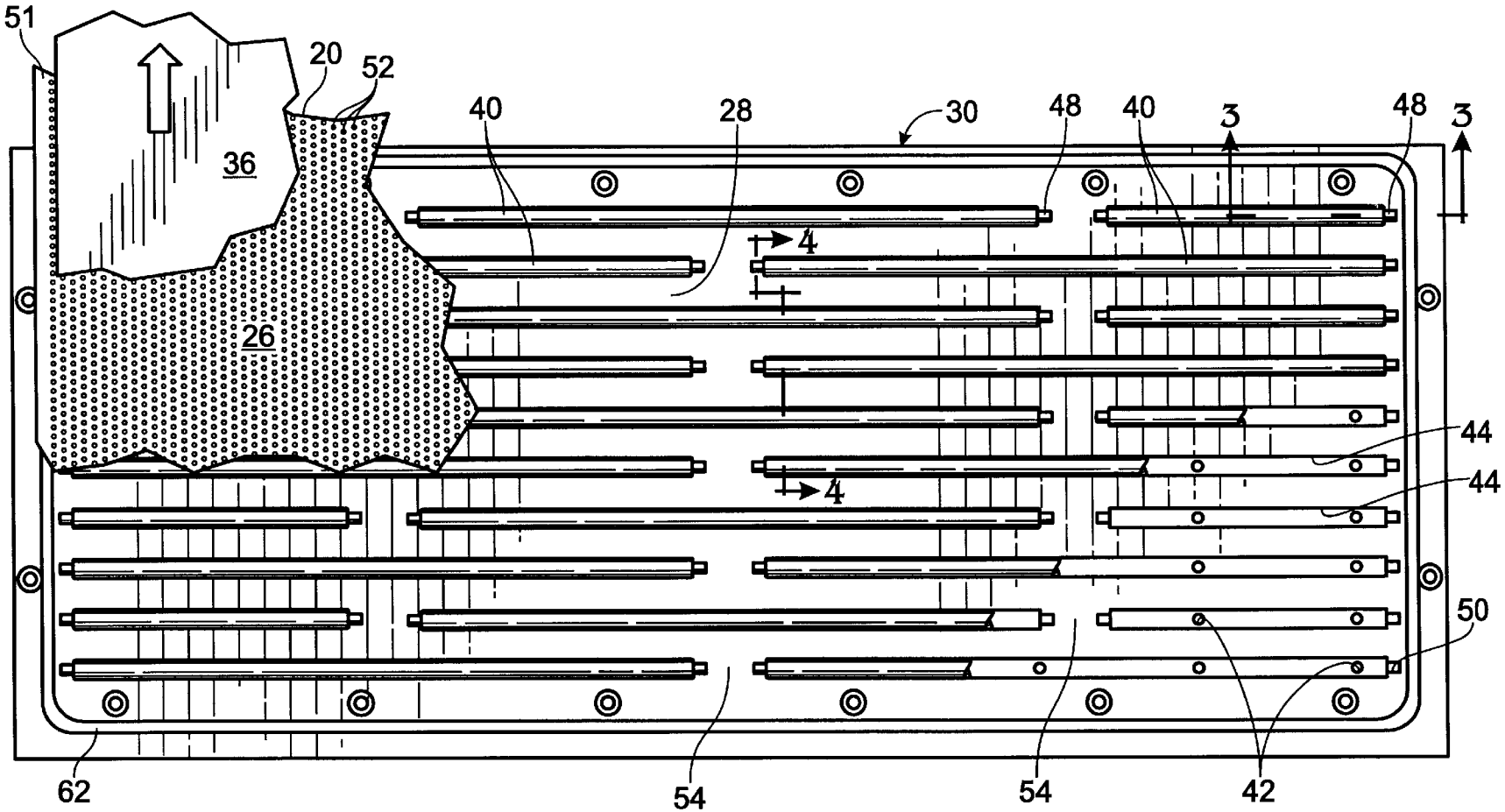
FIG. 2 is a top view, partly cut away, of a platen and belt used in the embodiment of FIG. 1.

The particulars of one preferred embodiment of the belt 20 and platen 30 are shown in FIGS. 1–4. FIG. 2 shows a top view of the platen 30. The platen is preferably formed of rigid metal such as stainless or plated steel or an aluminum alloy. The support surface 28 of the platen is configured to provide uniformly distributed vacuum pressure with minimal friction as the belt is moved over that surface. To this end, the platen support surface 28 includes rollers 40 and vacuum ports 42.

Figure 3:
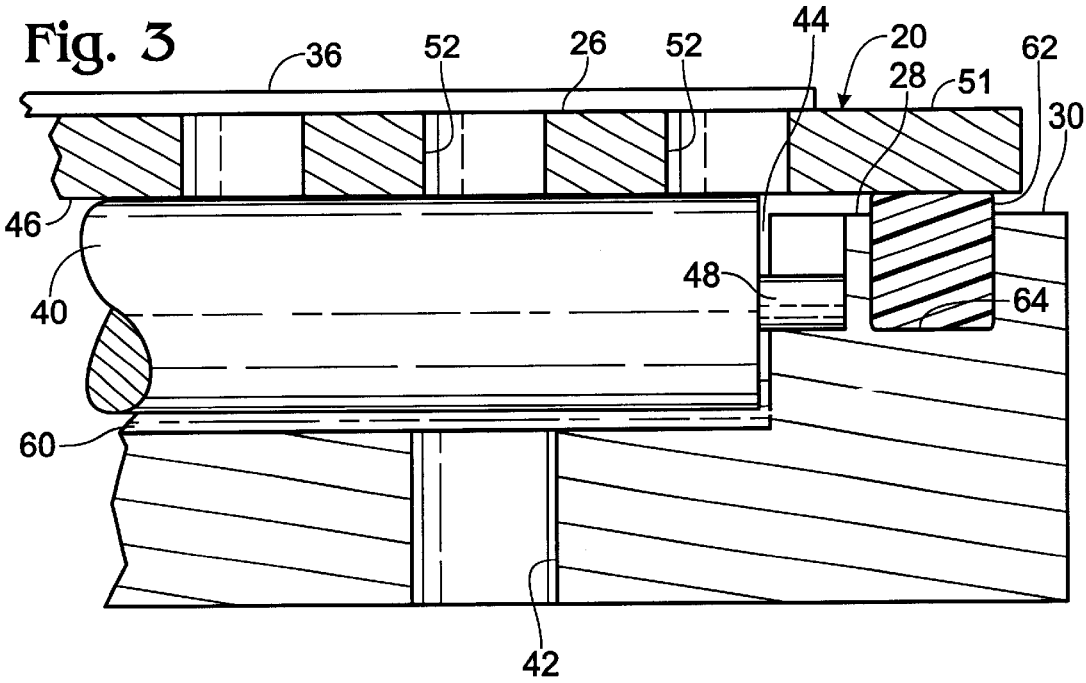
FIG. 3 is a cross sectional, detail view taken along line 3—3 of FIG. 2.
Figure 4:
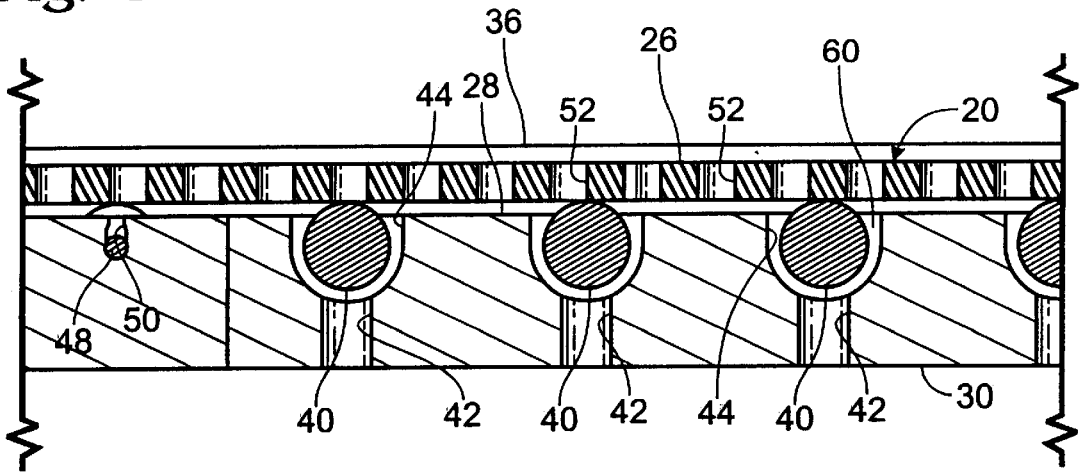
FIG. 4 is another cross sectional view taken along line 4—4 of FIG. 2.

More particularly, the support surface 28 of the platen 30 includes a number of spaced-apart elongated recesses 44. Each recess is generally U-shaped in cross section (FIG. 4). The cross sectional dimension of the recess 44 is such that most of a cylindrical roller 40 is received in an associated recess. A portion of the roller 40 protrudes above the support surface 28 of the platen 30 to contact the underside 46 of the belt 20 as best shown in FIGS. 3 and 4.

The ends of each roller 40 are formed into small diameter spindles 48. Each spindle 48 fits into a slot 50 made in the support surface 28 at opposite ends of each recess 44. Preferably, the opening of the slot 50 at the surface 28 is slightly narrower than the diameter of the spindle 48 so that the spindle can be snap fit into the slot, free to rotate in the slot, but not able to move out of the slot in the absence of a sufficient force applied to remove the roller 40.

As noted, rollers 40 protrude from the platen support surface 28 and thus provide rolling support for the belt 20 as it is driven across the platen. A preferred embodiment of the belt is formed of a stainless steel alloy, commonly known as Invar 36, having a thickness of about 0.125 mm or less. The belt 20 is perforated away from its margins 51 (FIGS. 2 and 3) with small holes 52. The holes have a diameter of 0.5 mm or less and are spaced such that the belt surface has a porosity of about 50%. Thus, as will be explained more below, vacuum pressure communicated to the underside 46 of the belt 20 is readily communicated to the paper 36 carried by the belt.

Other belt configurations are contemplated. For instance, a sheet of polyimide, such as DuPont's Kapton material, would suffice. Such a material could be formed into a very thin belt (for example, 0.05 mm) and would permit the use of smaller diameter drive and tension rollers 22, 24 because of the relatively high flexibility of this material as compared to steel.

The rollers 40 that support the belt 20 are arranged to ensure that the transport surface 26 of the belt remains planar as it moves across the platen support surface 28. That is, the belt is supported so that it will not sag or otherwise deform from the force developed by the application of vacuum pressure to the belt underside and the paper that the belt carries. In a preferred embodiment, the rollers 40 are spaced apart (top to bottom in FIG. 2) by no more than 8 mm.

The rollers 40 have a length that is considerably shorter than the width of the platen 30 (measured left to right in FIG. 2). In the embodiment shown in FIG. 2, the rollers 40 (hence, the recesses 44 in the platen support surface 28) are provided in two lengths, one being about twice as long as the other. There is a space 54 between the ends of axially aligned rollers 40. As shown in FIG. 2, the rollers 40 are arranged in a staggered pattern so that there are no such space 54 next to another. This roller arrangement thus ensures that there is no significantly sized unsupported area of the belt underside 46 that would otherwise permit deformation or sagging of the belt between rollers.

The vacuum pressure that is communicated from the vacuum box 32 through the ports 42 in the platen is distributed across the underside 46 of the belt 20. In this regard, the ports 42 extend between the interior of the vacuum box 32 and the bottom of a recess 44 (FIG. 3). The ports 42 are spaced apart along the length of the recesses (FIG. 2). The cross sectional size of each recess 40 is slightly larger than the diameter of the roller 40 that is received in the recess. As a result, a gap 60 surrounds each roller 40. Since the gaps are in fluid communication with the vacuum box via the ports 42, the gaps 60 thus serve to channel the vacuum pressure along the length of the rollers and to the overlying belt 20. Thus, the vacuum pressure for holding down the paper is well distributed to ensure that there is no movement of the paper 36 relative to the belt 20 as the paper is transported through the print zone 38.

It is contemplated that different port or channel arrangements could be provided in the platen 30 of the embodiment of FIGS. 1–4. For instance, the above described ports 42 could be supplemented with additional ports formed through the platen surface 28 in the areas between the recesses 44.

An air dam 62 (FIGS. 2, 3) is provided to limit the application of vacuum pressure to the underside 46 of the belt, so that there is no leak from the side edges of the platen 30, and so that vacuum leakage from the long edges of the platen is minimized. The air dam 62 is a continuous strip of smooth, somewhat resilient material such as Delrin or Nylon. The base of the dam 62 is anchored in a slot 64 in the platen support surface 28. At the sides of the platen, the upper end of the dam contacts the underside of the belt 20 at the non-perforated margins 51 of the belt. The width of the dam should be larger than the holes in the belt.

Figure 6:
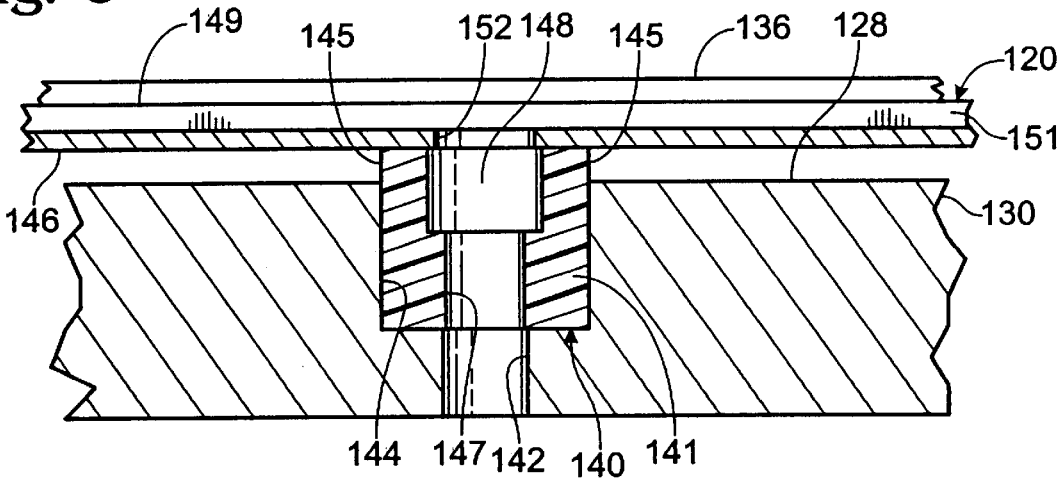
FIG. 6 is a cross sectional detail view taken along line 6—6 of FIG. 5.
Figure 7:
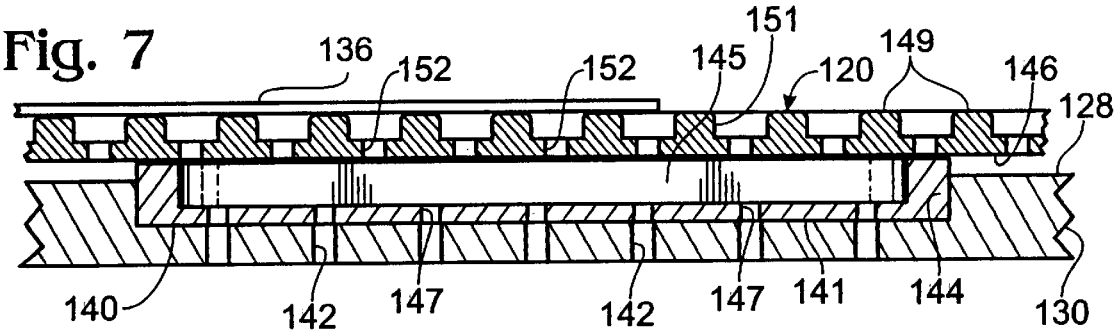
FIG. 7 is another cross sectional view taken along line 7—7 of FIG. 5
Figure 5:
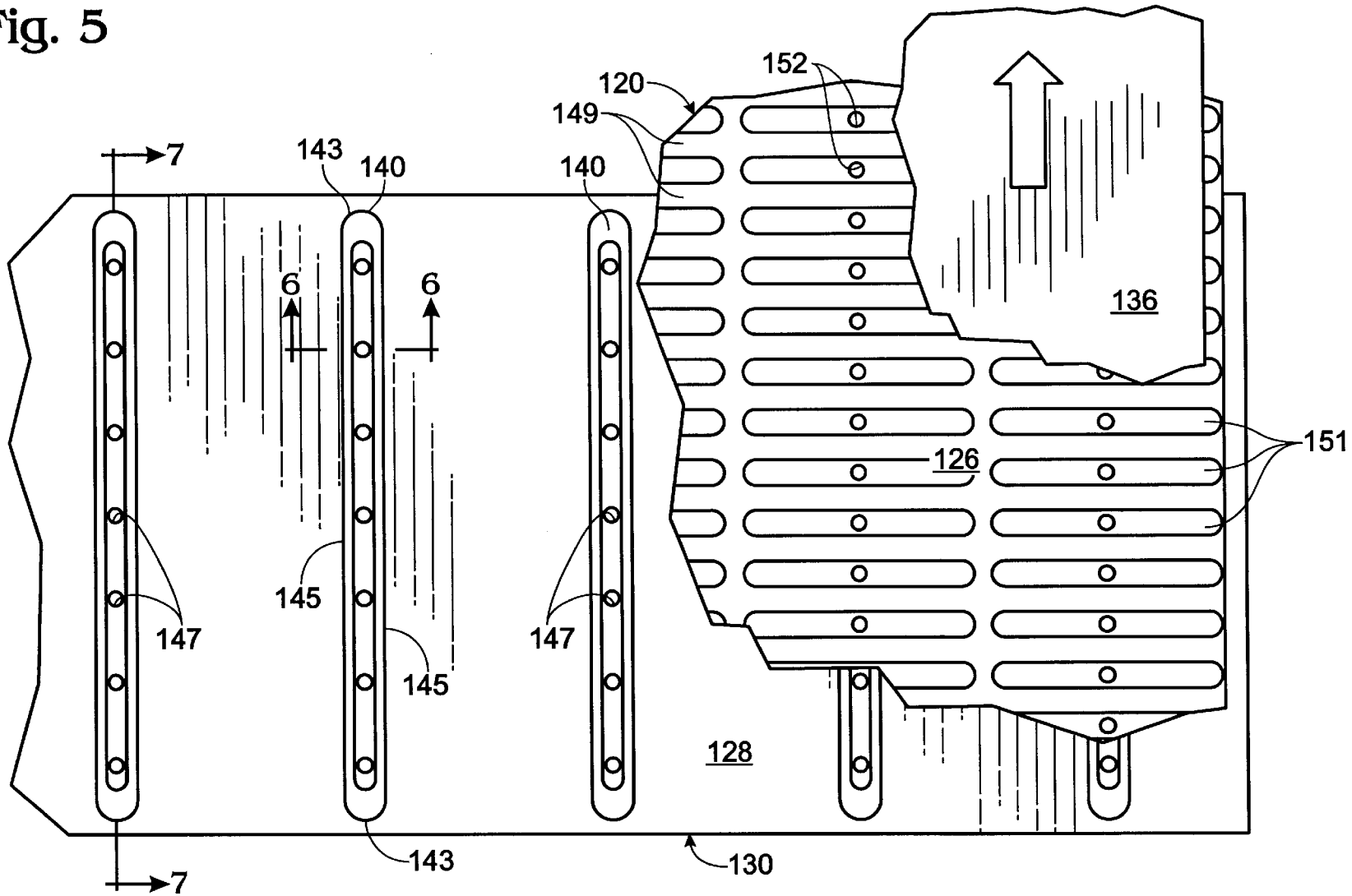
FIG. 5 is a top view, partly cut away, of another preferred embodiment of a platen and belt for transporting media.

An alternative embodiment of the present invention is depicted in FIGS. 5—7. This embodiment includes a belt 120 that, like the belt 20 shown in FIG. 1, is a generally flexible member that is configured as an endless loop to extend between the drive roller 22 and tension roller 24. The upper surface of the belt 120 is a transport surface 126 that moves over a planar support surface 128 of a platen 130.

The platen 130 forms the top of a vacuum box that, like the box 32 (FIG. 1), is partially evacuated via a suitable conduit to a vacuum source. As explained below, the belt 120 is driven to move print media such as paper 136 through the print zone of a printer.

Vacuum pressure developed in the vacuum box underlying the platen 130 is communicated through ports 142 in the platen 130. These ports 142 are arranged in several rows, parallel to the direction of travel of the belt 120 and paper 136. Each port 142 of a row of ports terminates in the base of an elongated groove 144 formed in the surface 128 of the platen 130. A slider 140 is seated in each groove 144. The sliders support the belt for sliding movement above the surface of the platen 130 and provide for the distribution of vacuum pressure from the ports 142.

Specifically, each slider is shaped from a solid strip of low-friction material, such as Dupont's polytetrafluoroethylene, as sold under the trademark Teflon. The base 141 of the slider fits into the groove 144 in the platen and is adhered thereto (FIG. 6). Two spaced-apart, parallel ridges 145 project upwardly from the base of the slider 140 to contact the underside 146 of the belt 120. As seen in FIG. 5, those ridges 145 are joined in a continuous arc shape at the short ends 143 of the sliders 140.

The base 141 of each slider also includes a set of apertures 147 formed through it. Preferably, the apertures are about the same size as the ports 142 in the platen. Each one of a set of apertures 147 is arranged to be axially aligned with a port 142 in an underlying row of ports in the platen, which ports terminate in the groove in which the slider 140 is carried. As a result, the vacuum pressure in the ports 142 is communicated through the slider apertures 147 into the space 148 between the parallel ridges 145.

This space 148 in each slider can be thought of as a vacuum manifold to which the moving belt 120 is connected. The belt 120 is configured in a manner such that the vacuum pressure in the manifold 148 is channeled across the transport surface 126 of the belt to thus draw to the paper 136 against that surface 126. In this regard, the belt 120 of this embodiment is generally impervious to air except for the part of the belt that aligns with the sliders 140. There, rows of holes 152 are formed through the belt to permit fluid communication between the underlying vacuum manifolds 148 and the surface of the transport surface 126 of the belt, which faces the paper 136.

The diameter of each belt hole 152 is smaller than the space between the ridges 145 of the slider (FIG. 6). Thus, solid portions of the belt 120 (that is, portions with no holes 152) rest on the upper surfaces of the ridges 145 so that the vacuum pressure in the manifold 148 is communicated only through the belt holes 152 through belt 120. The transport surface 126 is configured with ribs and channels for distributing this vacuum pressure across the width of the belt as described next.

The belt 120 is a molded rubber compound that is reinforced with woven strips of Kevlar material. The transport surface 126 of the belt 120 is corrugated with parallel, upwardly extending ribs 149. The ribs 149 extend across the width of the belt. The paper 136 carried by the belt rests on these ribs.

At locations between the belt holes 152 the ribs 149 are joined so that channels 151 are defined between each adjacent pair of ribs 149 and between the rib junctions (FIG. 5). The above-described belt holes 152 open into the channels. As a result, the vacuum pressure in the slider manifolds 148 is communicated via the holes 152 into the channels 151 for thus applying suction to the portion of the paper covering the channels to secure the paper to the moving belt.

The size and spacing of the ribs 149 are selected so that print media carried by the belt is not deformed into the channels 151 upon the application of the vacuum pressure. When conventional paper stock is used, the channel width is preferably between 1.0 and 3.0 mm and the depth is between 0.5 and 1.5 mm.

Figure 8:
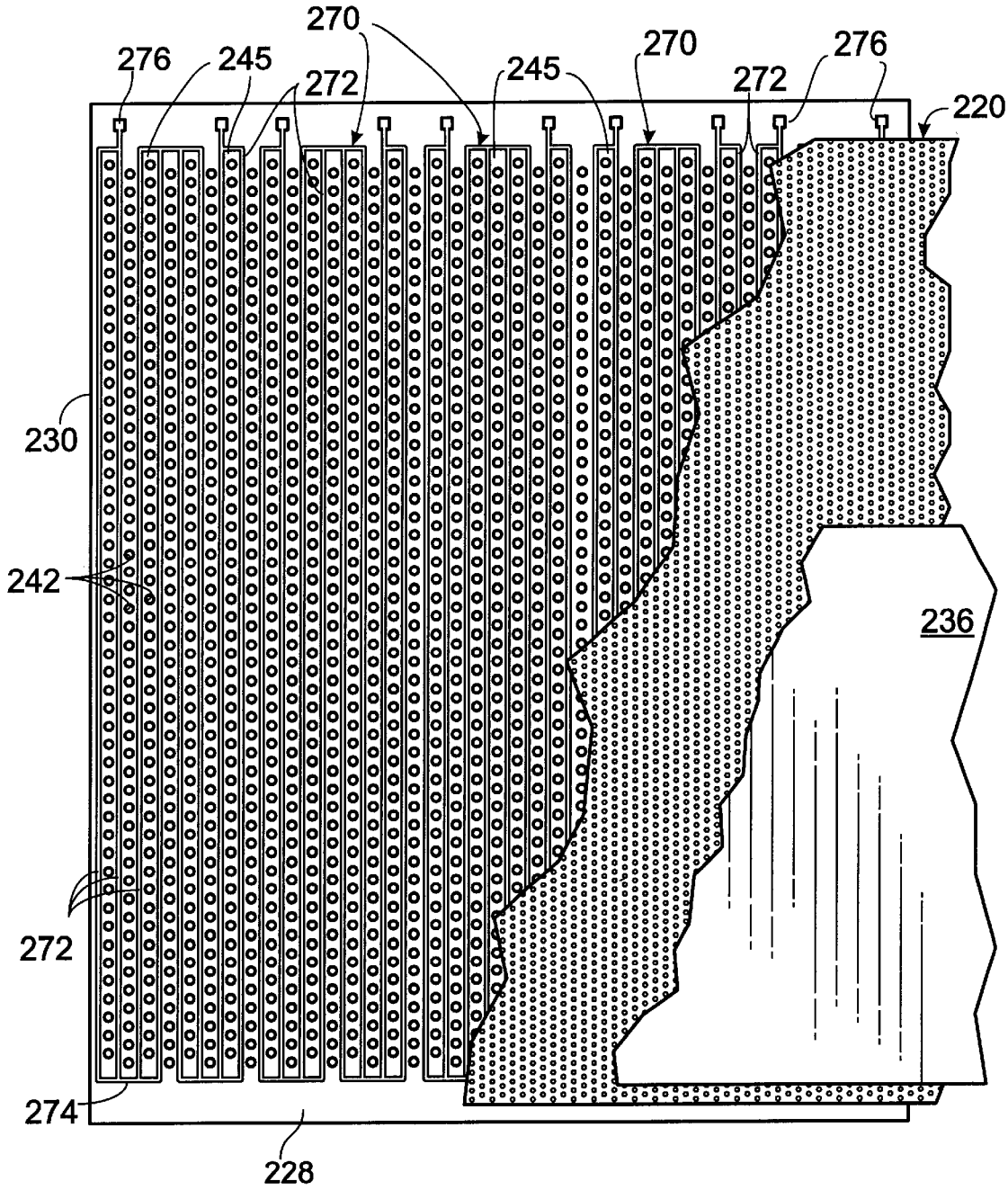
FIG. 8 is a top view, partly cut away, of another preferred embodiment of a platen and belt for transporting media.

Another preferred embodiment of the present invention is depicted in FIG. 8. In this embodiment, the platen 230 has a planar support surface 228. Ports 242 in the platen open to the support surface 228. The ports are preferably formed in uniform rows across the support surface and are sized to ensure that vacuum pressure is uniformly distributed over the platen surface 228. Preferably, the ports are circular where they open to the surface 228. The circles are 3.0 mm in diameter and spaced apart by 6.0 mm to 6.25 mm. This arrangement of ports thereby provides a platen support surface having more than 33% of its area covered with vacuum ports. Of course, other port sizes and configurations can be used to arrive at an equivalent distribution of ports over the support surface of the platen.

In this embodiment, protrusions, in the form of heaters 270, are attached to the support surface 228 of the platen 230. The heaters 270 are comprised of an array of linear, resistive heating elements 272 (preferably, eight elements 272 for each heater 270). The heating elements 272 extend between the rows of vacuum ports 242 on the support surface 228 of the platen. At the edges of the support surface 228 the individual heating elements 272 are joined (as at reference numeral 274) and the termini of the heaters are enlarged into two contact pads 276 for connecting to a current source and ground in the event it is desirable to heat the belt 220 (hence the paper 236 that it carries) in order to, for example, speed the drying of liquid ink applied to the paper.

In this embodiment, the belt 220 generally matches the belt 20 described above with respect to FIG. 2. This belt 220, however, does not require non-perforated margins (nor does the platen surface include an air dam). The underside of the belt 220 slides over the top surfaces of the heating elements 272 as the belt is driven to move paper 236 through the print zone. Preferably, the underside of the belt is thinly coated with a layer of low-friction material, such as Dupont's polytetrafluoroethylene sold under the trademark Teflon. Such a coating may also (or, alternatively) be applied to the support surface 228.

The protruding heating elements 272 are advantageously employed for facilitating the distribution of the vacuum pressure that is communicated to the belt 220 via the ports 242 in the platen. In this regard, the space between adjacent heating elements 272 and between the belt 220 and support surface 228 of the platen defines an elongated channel 245 that is continuous with the each port 242 in a row of ports 242. Thus, each channel helps to distribute vacuum pressure across the entire width of the porous belt 220.

Before turning to a more detailed description of the heaters, it is noteworthy here that the protrusions that provide the vacuum distribution may be in the form of something other than heaters. For example, the protrusions may be integrally formed with the surface 228 of the platen 230, or otherwise attached passive (non-heating) members. The platen material may be as described above (rigid metal such as stainless steel or an aluminum alloy). Alternatively, the platen comprising the support surface may be formed of a thin sheet of ceramic material to provide a robust platen as respects, especially, the ability of the platen to maintain its planar shape despite heating and cooling cycles.

In this preferred embodiment, the heaters 270 are arranged so that at least one heater resides on the central portion of the platen 230 immediately underlying the print zone 38 described above. There are also heaters on either side of the central heater, to respectively preheat the media and complete the process of drying the ink on the media after it leaves the print zone.

The heaters 270 are a thick-film type. The heaters include a ceramic or stainless steel base layer that is silk-screened onto the support surface 228 of the platen in the pattern depicted in FIG. 8. Resistive paste layers are then deposited between vitreous dielectric layers, which are dried and fired to produce an integrated heating element 272. The heating elements 272 are about 1.5 mm wide (as measured left to right in FIG. 8) and protrude by about 0.05 to 0.10 mm above the support surface 228 of the platen 230.

Although preferred and alternative embodiments of the present invention have been described, it will be appreciated by one of ordinary skill that the spirit and scope of the invention is not limited to those embodiments, but extend to the various modifications and equivalents as defined in the appended claims.

What is claimed is:

1. An apparatus for supporting print media within a printer, comprising:

a platen having ports formed therein for communicating vacuum pressure to a support surface of the platen;

a belt having holes formed therein and mounted for movement relative to the platen to convey a sheet of print media over the support surface of the platen; and a plurality of rollers mounted to the platen support surface to extend between the belt and the platen support surface and defining channels between pairs of rollers for communicating vacuum pressure from the support surface of the platen through the holes in the belt.

2. The apparatus of claim 1 wherein the platen has a plurality of recesses formed in the support surface, each recess being sized for receiving a roller.

3. The apparatus of claim 2 wherein at least some of the ports are formed in the recesses in the support surface.

4. The apparatus of claim 1 further comprising an air dam protruding from the support surface and extending between the support surface and the underside of the belt to surround the ports.

5. The apparatus of claim 1 wherein the belt is substantially porous and wherein the belt support means includes a layer of low-friction material disposed between the belt and the support surface.

6. An apparatus for supporting print media within a printer, comprising:

a platen having ports formed therein for communicating vacuum pressure to a support surface of the platen;

a belt having holes formed therein and mounted for movement relative to the platen to convey a sheet of print media over the support surface of the platen; and wherein the belt has a transport surface to which print media may be directed for conveyance by that surface over the support surface of the platen, and wherein the belt is corrugated with spaced apart ribs that extend therefrom to define the transport surface as well as channels for distributing vacuum pressure across the belt.

7. The apparatus of claim 6 further comprising support sliders fit into grooves in the platen for supporting the underside of the belt in spaced relation to the support surface.

8. The apparatus of claim 7 wherein each support slider includes a pair of upwardly projecting ridges for contacting the underside of the belt and defining between the ridges a vacuum manifold that is in fluid communication with the ports in the platen.

9. A method of supporting a sheet of print media that is advanced in a first direction through a printer that has a print zone in which ink is applied to the media, the method comprising the steps of:

supporting a belt on a plurality of rollers for movement above and spaced from a planar surface of a platen so that there is a space between the planar surface and the belt, wherein the rollers are spaced apart across the planar surface and located within the space between the planar surface and the belt;

establishing vacuum pressure in the space between the planar surface and the belt; and drawing a sheet of print media against the moving belt as the belt moves across the platen.

10. The method of claim 9 including the steps of moving the belt through the print zone and channeling vacuum pressure across the belt for drawing the sheet of print media against the belt.

11. The method of claim 9 including the step of providing a porous, steel-alloy belt as the belt that is moved across the platen.

12. The method of claim 9 including the step of seating the rollers in recesses formed in the platen and communicating vacuum pressure through the recesses near the rollers for drawing the sheet of print media against the moving belt.

13. The method of claim 9 including the step of providing a coating of low friction material to the belt.

* * * * *